US008693934B2

(12) United States Patent
Hasegawa et al.

(10) Patent No.: US 8,693,934 B2
(45) Date of Patent: Apr. 8, 2014

(54) FIXING DEVICE AND IMAGE FORMING APPARATUS INCORPORATING SAME

(75) Inventors: Motokazu Hasegawa, Kanagawa (JP); Susumu Matsusaka, Kanagawa (JP); Tsuyoshi Hashiyada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 117 days.

(21) Appl. No.: 13/305,015

(22) Filed: Nov. 28, 2011

(65) Prior Publication Data

US 2012/0155933 A1 Jun. 21, 2012

(30) Foreign Application Priority Data

Dec. 17, 2010 (JP) ..... 2010-281886

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS

| | | | |
|---|---|---|---|
| 7,196,286 | B2 | 3/2007 | Kishi et al. |
| 7,209,675 | B2 | 4/2007 | Matsusaka et al. |
| 7,239,821 | B2 | 7/2007 | Matsusaka et al. |
| 7,308,216 | B2 | 12/2007 | Kishi et al. |
| 7,313,341 | B2 | 12/2007 | Matsusaka et al. |
| 7,333,743 | B2 | 2/2008 | Kishi et al. |
| 7,343,113 | B2 | 3/2008 | Matsusaka et al. |
| 7,356,270 | B2 | 4/2008 | Matsusaka et al. |
| 7,366,432 | B2 | 4/2008 | Kishi et al. |
| 7,390,995 | B2 | 6/2008 | Hasegawa et al. |
| 7,415,235 | B2 | 8/2008 | Aze et al. |
| 7,421,224 | B2 | 9/2008 | Kishi et al. |
| 7,447,475 | B2 | 11/2008 | Ishibe et al. |
| 7,480,478 | B2 | 1/2009 | Aze et al. |
| 7,496,309 | B2 | 2/2009 | Matsusaka et al. |

(Continued)

FOREIGN PATENT DOCUMENTS

| | | |
|---|---|---|
| CN | 101546165 | 9/2009 |
| JP | 2005-150103 | 6/2005 |

(Continued)

OTHER PUBLICATIONS

Machine translation of JP 2009-271156 obtained on Aug. 15, 2013.*

(Continued)

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A fixing device includes an induction heater disposed opposite a heating rotary body and including a first side core disposed at one end of the induction heater, a second side core disposed at another end of the induction heater in a direction of rotation of the heating rotary body, and a plurality of arch cores arranged in an axial direction of the heating rotary body. Each arch core includes a first vault edge face disposed at one end of the arch core in the direction of rotation of the heating rotary body and contacting a planar face of the first side core and a second vault edge face disposed at another end of the arch core in the direction of rotation of the heating rotary body and contacting a planar face of the second side core.

8 Claims, 8 Drawing Sheets

(56) References Cited

U.S. PATENT DOCUMENTS

| | | | |
|---|---|---|---|
| 7,515,845 | B2 | 4/2009 | Kishi et al. |
| 7,551,869 | B2 | 6/2009 | Kishi et al. |
| 7,565,087 | B2 | 7/2009 | Matsusaka et al. |
| 7,603,049 | B2 | 10/2009 | Kishi et al. |
| 7,609,988 | B2 | 10/2009 | Kishi et al. |
| 7,664,410 | B2 | 2/2010 | Takagi |
| 7,664,450 | B2 | 2/2010 | Aze et al. |
| 7,885,569 | B2 | 2/2011 | Kishi et al. |
| 7,957,663 | B2 | 6/2011 | Kishi et al. |
| 2006/0051111 | A1 | 3/2006 | Kishi et al. |
| 2011/0176819 | A1 | 7/2011 | Ide et al. |

FOREIGN PATENT DOCUMENTS

| | | | |
|---|---|---|---|
| JP | 2006-350054 | | 12/2006 |
| JP | 2007-264021 | | 10/2007 |
| JP | 2009271156 A | * | 11/2009 |

OTHER PUBLICATIONS

Machine translation of JP 2007-264021 obtained on Aug. 15, 2013.*

Chinese Office Action for Chinese Patent Application No. 201110407954.0 dated Dec. 30, 2013.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-281886, filed on Dec. 17, 2010, in the Japanese Patent Office, the entire disclosure of which is hereby incorporated by reference herein.

FIELD OF THE INVENTION

Exemplary aspects of the present invention relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ an induction heater to warm up the fixing device quickly to a predetermined fixing temperature with reduced energy consumption. FIG. 1 illustrates a fixing device 19 with such induction heater 24 installed. As shown in FIG. 1, the induction heater 24 generates a magnetic flux that generates an eddy current in proximity to a heating roller 23. The eddy current causes the heating roller 23 including a heat generation layer to generate Joule heat by electric resistance of the heating roller 23, which in turn heats a fixing belt 22 stretched over the heating roller 23 and a fixing roller 21 and rotating in a predetermined direction of rotation. As a recording medium P bearing a toner image T passes through a fixing nip N formed between a pressing roller 34 and the fixing belt 22, the heated fixing belt 22 and the pressing roller 34 apply heat and pressure to the recording medium P, thus fixing the toner image T on the recording medium P.

The induction heater 24 includes an exciting coil 25 that generates a magnetic flux and a plurality of arch cores 26*c* that guides the magnetic flux generated by the exciting coil 25 to the heating roller 23. In order to minimize leakage of magnetic flux, the induction heater 24 further includes a center core 26*a* disposed at a center of the induction heater 24, a side core 26*b*1 disposed at one end of the induction heater 24, and a side core 26*b*2 disposed at another end of the induction heater 24 in the direction of rotation of the fixing belt 22. For example, each arch core 26*c* has a planar edge face 26*c*1 disposed at one end of the arch core 26*c* in the direction of rotation of the fixing belt 22 and contacting a planar face of the side core 26*b*1 and a planar edge face 26*c*2 disposed at another end of the arch core 26*c* in the direction of rotation of the fixing belt 22 and contacting a planar face of the side core 26*b*2. Thus, the plurality of arch cores 26*c* and the side cores 26*b*1 and 26*b*2 contacting the arch cores 26*c* can direct the magnetic flux toward the heating roller 23 while minimizing the leakage of magnetic flux from between the arch cores 26*c* and the side cores 26*b*1 and 26*b*2.

Generally, a ferrite core, which is produced by compression-molding and sintering ferrite powder, is used in the induction heater 24. During the sintering process, the core shrinks. Taking the arch core 26*c* for instance, a shrinkage of an edge portion in proximity to the span of the arch core 26*c* may differ from a shrinkage of other portions of the arch core 26*c*, widening the span to a degree varying from one arch core 26*c* to the next. Accordingly, some arch cores 26*c* may contact the planar faces of the side cores 26*b*1 and 26*b*2 flush, that is, evenly and precisely over the entire planar edge faces 26*c*1 and 26*c*2 of the arch core 26*c*, while other arch cores 26*c* may contact the planar faces of the side cores 26*b*1 and 26*b*2 unevenly, at only a part of the planar edge faces 26*c*1 and 26*c*2 of the arch core 26*c*. Such variation in contact state in which the arch cores 26*c* contact the side cores 26*b*1 and 26*b*2 may affect generation of a magnetic path in the longitudinal direction of the induction heater 24 parallel to the long axis of the heating roller 23. For example, some sections of the induction heater 24 where the magnetic path is appropriately generated heat the heating roller 23 efficiently. Conversely, other sections of the induction heater 24 where the magnetic path is inappropriately generated leak the magnetic flux generated by the exciting coil 25 from between the arch core 26*c* and the side cores 26*b*1 and 26*b*2, degrading heating efficiency of the heating roller 23 and thus resulting in variation in the temperature of the heating roller 23 in the axial direction thereof. Consequently, the heating roller 23 does not heat the fixing belt 22 uniformly in the axial direction thereof, thus forming a faulty toner image T on a recording medium P.

To address these problems, additional cutting is required to cause the planar edge faces 26*c*1 and 26*c*2 of the arch core 26*c* to precisely contact the planar faces of the side cores 26*b*1 and 26*b*2. However, such additional cutting increases manufacturing costs of the arch cores 26*c*.

SUMMARY OF THE INVENTION

This specification describes below an improved fixing device. In one exemplary embodiment of the present invention, the fixing device includes a heating rotary body, including a heat generation layer, to rotate in a predetermined direction of rotation and an induction heater, disposed opposite the heating rotary body, to generate a magnetic flux toward the heating rotary body. The induction heater includes a first side core, including a planar face, disposed at one end of the induction heater in the direction of rotation of the heating rotary body and extending in an axial direction of the heating rotary body; a second side core, including a planar face, disposed at another end of the induction heater in the direction of rotation of the heating rotary body and extending in the axial direction of the heating rotary body; a center core disposed between the first side core and the second side core in the direction of rotation of the heating rotary body; an exciting coil to generate the magnetic flux, wound around the center core; and a plurality of arch cores arranged in the axial direction of the heating rotary body. Each of the arch cores includes a first vault edge face disposed at one end of the arch core in the direction of rotation of the heating rotary body and contacting the planar face of the first side core and a second vault edge face disposed at another end of the arch core in the direction of rotation of the heating rotary body and contacting the planar face of the second side core.

This specification further describes below an improved fixing device. In one exemplary embodiment of the present invention, the fixing device includes a heating rotary body, including a heat generation layer, to rotate in a predetermined direction of rotation and an induction heater, disposed opposite the heating rotary body, to generate a magnetic flux toward the heating rotary body. The induction heater includes a first side core, including a planar face, disposed at one end of the induction heater in the direction of rotation of the heating rotary body and extending in an axial direction of the heating rotary body; a second side core, including a planar face, disposed at another end of the induction heater in the direction of rotation of the heating rotary body and extending in the axial direction of the heating rotary body; a center core disposed between the first side core and the second side core in the direction of rotation of the heating rotary body; an exciting coil to generate the magnetic flux, wound around the center core; and a plurality of first and second arch cores arranged in the axial direction of the heating rotary body. Each of the first arch cores includes a first vault edge face disposed at one end of the first arch core in the direction of rotation of the heating rotary body and contacting the planar face of the first side core. Each of the second arch cores includes a second vault edge face disposed at one end of the second arch core in the direction of rotation of the heating rotary body and contacting the planar face of the second side core.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
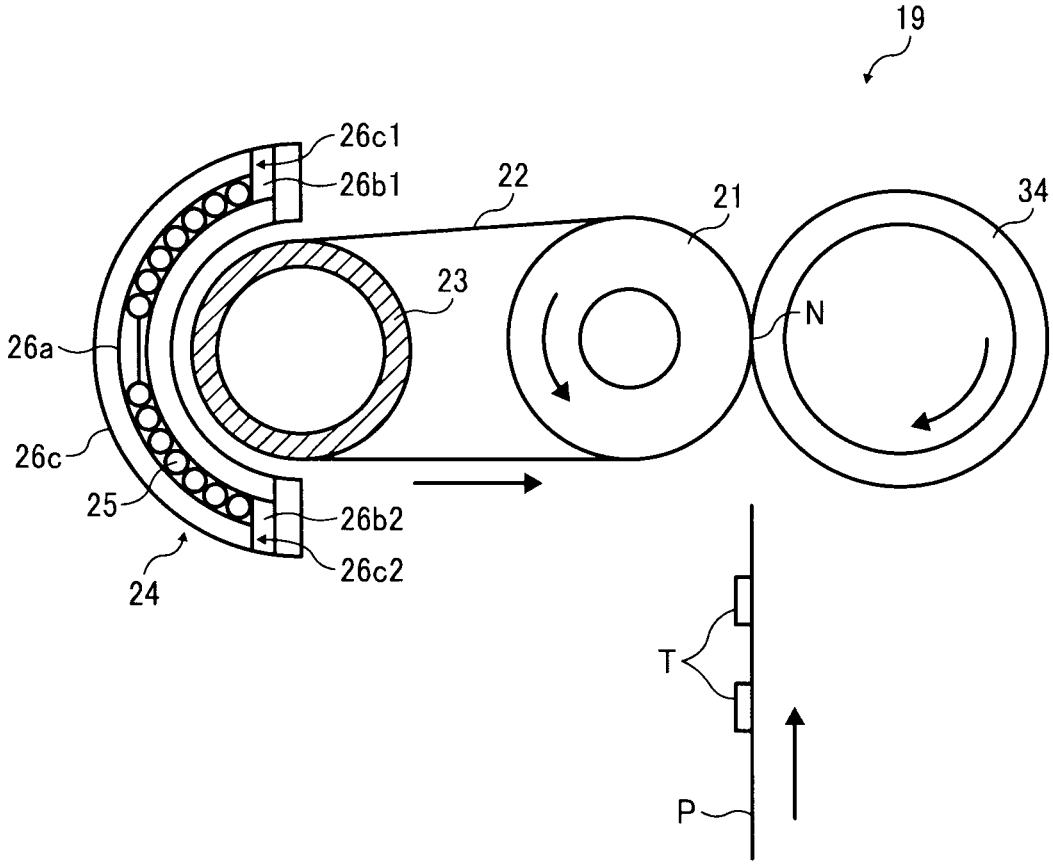
FIG. 1 RELATED ART
FIG. 1 is a vertical sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
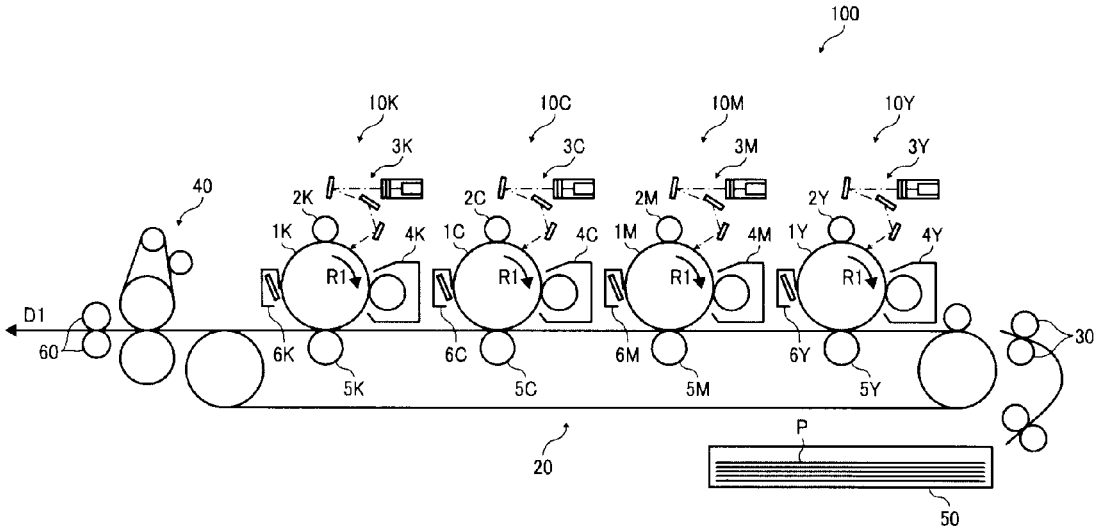
FIG. 2 is a schematic sectional view of an image forming apparatus according to an exemplary embodiment of the present invention.

Referring now to the drawings, wherein like reference numerals designate identical or corresponding parts throughout the several views, in particular to FIG. 2, an image forming apparatus 100 according to an exemplary embodiment of the present invention is explained.

FIG. 2 is a schematic sectional view of the image forming apparatus 100. As illustrated in FIG. 2, the image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a tandem printer for forming a color image on a recording medium by electrophotography.

Referring to FIG. 2, the following describes the structure of the image forming apparatus 100. As illustrated in FIG. 2, the image forming apparatus 100 includes four image forming devices 10Y, 10M, 10C, and 10K including photoconductive drums 1Y, 1M, 1C, and 1K serving as image carriers that carry yellow, magenta, cyan, and black toner images, respectively, formed thereon by electrophotography.

Below the image forming devices 10Y, 10M, 10C, and 10K is a conveyance belt 20, stretched over a plurality of rollers including transfer rollers 5Y, 5M, 5C, and 5K, that conveys a recording medium P (e.g., a sheet) passing below the image forming devices 10Y, 10M, 10C, and 10K.

For example, the photoconductive drums 1Y, 1M, 1C, and 1K contact the conveyance belt 20. The recording medium P electrostatically attracted to an outer circumferential surface of the conveyance belt 20 passes between the conveyance belt 20 and the photoconductive drums 1Y, 1M, 1C, and 1K.

The four image forming devices 10Y, 10M, 10C, and 10K have substantially the same structure. Accordingly, a description is now given of the rightmost image forming device 10Y in FIG. 2, disposed upstream from the other image forming devices 10M, 10C, and 10K in a recording medium conveyance direction D1, that forms a yellow toner image on the photoconductive drum 1Y. Therefore, a description of the image forming devices 10M, 10C, and 10K is omitted.

The image forming device 10Y includes the photoconductive drum 1Y disposed at substantially a center of the image forming device 10Y and contacting the conveyance belt 20. The photoconductive drum 1Y is surrounded by a charger 2Y, an exposure device 3Y, a development device 4Y, the transfer roller 5Y, a cleaner 6Y, and a discharger disposed in this order in a rotation direction R1 of the photoconductive drum 1Y. For example, the charger 2Y charges an outer circumferential surface of the photoconductive drum 1Y to a predetermined potential. The exposure device 3Y exposes the charged outer circumferential surface of the photoconductive drum 1Y with light (e.g., a laser beam) according to yellow image data sent from an external device (e.g., a client computer), forming an electrostatic latent image on the photoconductive drum 1Y. Then, the development device 4Y supplies yellow toner to the electrostatic latent image formed on the photoconductive drum 1Y, visualizing the electrostatic latent image as a yellow toner image. The transfer roller 5Y serving as a transfer device transfers the yellow toner image formed on the photoconductive drum 1Y onto a recording medium P sent from a paper tray 50 and conveyed on the conveyance belt 20. Thereafter, the cleaner 6Y removes residual toner not transferred onto the recording medium P and therefore remaining on the photoconductive drum 1Y from the photoconductive drum 1Y. Finally, the discharger (e.g., a lamp) discharges the outer circumferential surface of the photoconductive drum 1Y, removing a residual potential remaining on the photoconductive drum 1Y. Thus, a series of image forming processes performed on the photoconductive drum 1Y by the image forming device 10Y is completed.

A description is now given of a series of image forming processes performed on the recording medium P.

The recording medium P is sent from the paper tray 50 disposed below the conveyance belt 20 toward a registration roller pair 30. The registration roller pair 30 temporarily stops the recording medium P sent from the paper tray 50 and feeds the recording medium P toward the conveyance belt 20 at a proper time when the yellow toner image formed on the photoconductive drum 1Y is transferred onto the recording medium P conveyed on the conveyance belt 20. Subsequently, magenta, cyan, and black toner images formed on the photoconductive drums 1M, 1C, and 1K, respectively, similarly according to the image forming processes described above are sequentially transferred onto the recording medium P as the conveyance belt 20 conveys the recording medium P in such a manner that the magenta, cyan, and black toner images are superimposed on the yellow toner image. Thus, a color toner image is formed on the recording medium P.

Downstream from the conveyance belt 20 in the recording medium conveyance direction D1 is a fixing device 40 that fixes the color toner image on the recording medium P. The recording medium P bearing the color toner image is conveyed through a conveyance path extending from the conveyance belt 20 to the fixing device 40.

As the recording medium P passes through the fixing device 40, the fixing device 40 applies heat and pressure to the recording medium P, melting and fixing the color toner image on the recording medium P. Downstream from the fixing device 40 in the recording medium conveyance direction D1 is an output roller pair 60 disposed in the conveyance path extending from the fixing device 40. The output roller pair 60 discharges the recording medium P bearing the fixed color toner image onto an outside of the image forming apparatus 100.

Figure 3:
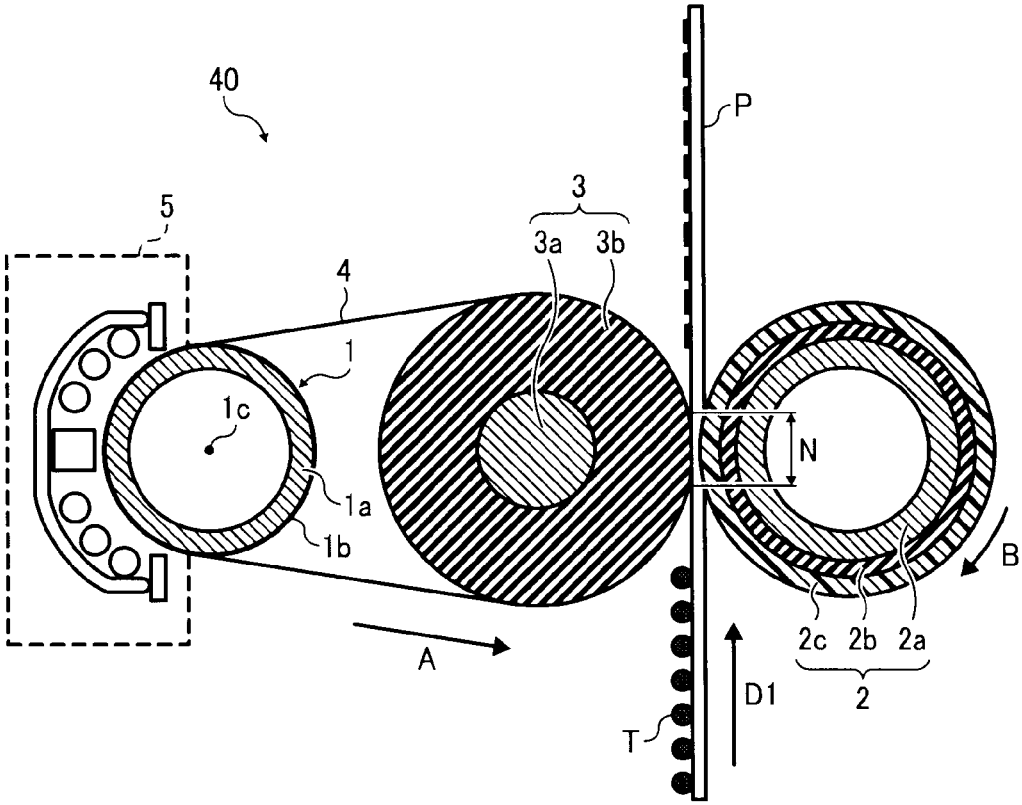
FIG. 3 is a vertical sectional view of a fixing device installed in the image forming apparatus shown in FIG. 2.

Referring to FIG. 3, the following describes the structure of the fixing device 40 installed in the image forming apparatus 100 described above.

Figure 4:
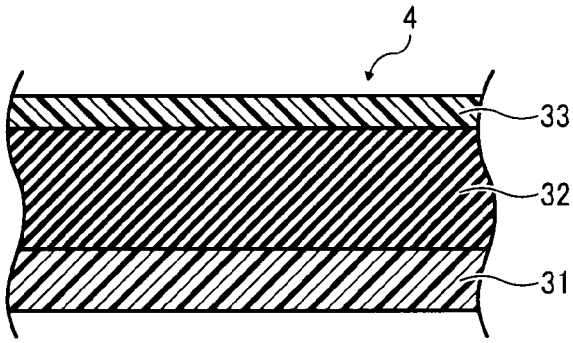
FIG. 4 is a partial vertical sectional view of a fixing belt installed in the fixing device shown in FIG. 3.

FIG. 3 is a vertical sectional view of the fixing device 40. As illustrated in FIG. 4, the fixing device 40 (e.g., a fuser) includes a heating roller 1, a fixing roller 3, a fixing belt 4 stretched over the heating roller 1 and the fixing roller 3, an induction heater 5 disposed opposite the heating roller 1 via the fixing belt 4, and a pressing roller 2 pressed against the fixing roller 3 via the fixing belt 4 to form a fixing nip N between the pressing roller 2 and the fixing belt 4. As the fixing belt 4 rotating in a rotation direction A and the pressing roller 2 rotating in a rotation direction B counter to the rotation direction A of the fixing belt 4 convey a recording medium P bearing a toner image T through the fixing nip N, the fixing belt 4 heated by the induction heater 5 via the heating roller 1 and the pressing roller 2 apply heat and pressure to the recording medium P, thus fixing the toner image T on the recording medium P.

For example, the heating roller 1 serving as a heating rotary body is a hollow roller constructed of a metal core 1*a* and a surface layer 1*b* disposed on the metal core 1*a*. The metal core 1*a* is a stainless steel layer having a thickness in a range of from about 0.2 mm to about 1.0 mm and serves as a heat generation layer that generates heat by a magnetic flux generated by the induction heater 5. The surface layer 1*b* is a copper layer, having a thickness in a range of from about 3 micrometers to about 15 micrometers, which enhances heat generation efficiency of the metal core 1*a*. Preferably, the surface layer 1*b* may be nickel plated for rust prevention.

Alternatively, the metal core 1*a* may be a magnetic shunt alloy layer having a Curie point in a range of from about 160 degrees centigrade to about 220 degrees centigrade. The magnetic shunt alloy layer may include aluminum to prevent the heating roller 1 from being heated to above the Curie point without a control mechanism that controls the temperature of the heating roller 1.

Like the stainless steel layer, the magnetic shunt alloy layer may be provided with the copper surface layer 1*b* thereon to improve heat generation efficiency of the metal core 1*a*. As a counteraction to improvement in heat generation efficiency of the metal core 1*a*, the copper surface layer 1*b* causes the magnetic shunt alloy layer to heat itself above the predetermined Curie point. To address this problem, the copper surface layer 1*b* may have a thickness not greater than about 10 micrometers. The thinner copper surface layer 1*b* facilitates control for decreasing the temperature of the magnetic shunt alloy layer to about the Curie point.

The fixing roller 3 is constructed of a metal core 3*a* made of stainless steel, carbon steel, or the like and an elastic layer 3*b* covering the metal core 3*a* and made of solid silicone rubber, silicone rubber foam, or the like having heat resistance. The pressing roller 2 presses against the fixing roller 3 via the fixing belt 4 to form the fixing nip N between the pressing roller 2 and the fixing belt 4 having a predetermined nip length in the recording medium conveyance direction D1. Preferably, the fixing roller 3 may have an outer diameter in a range of from about 30 mm to about 80 mm. The elastic layer 3*b* may have a thickness in a range of from about 3 mm to about 30 mm and a hardness in a range of from about 10 degrees to about 50 degrees under JIS-A of Japanese Industrial Standards.

Referring to FIG. 4, a description is now given of the fixing belt 4. FIG. 4 is a partial vertical sectional view of the fixing belt 4.

As illustrated in FIG. 4, the fixing belt 4 is constructed of a base layer 31, an elastic layer 32 disposed on the base layer 31, and a release layer 33 disposed on the elastic layer 32.

The base layer 31 is required to have a mechanical strength and a flexibility great enough to stretch the fixing belt 4 over the heating roller 1 and the fixing roller 3 and a heat resistance great enough to operate the fixing belt 4 at a fixing temperature in a range of from about 160 degrees centigrade to about 220 degrees centigrade. Preferably, the base layer 31 may be made of an insulating heat resistant resin material to allow the induction heater 5 to heat the heating roller 1 by electromagnetic induction, for example, polyimide, polyimideamide, polyetheretherketone (PEEK), polyethersulfide (PES), polyphenylene sulfide (PPS), fluorocarbon resin, or the like. The base layer 31 may have a thickness in a range of from about 10 micrometers to about 200 micrometers in view of a relation between heat capacity and mechanical strength.

The elastic layer 32 imparts flexibility to an outer circumferential surface of the fixing belt 4 that contacts the toner image T on the recording medium P so that the fixing belt 4 applies heat and pressure to the recording medium P uniformly to form the toner image T having a uniform gloss. Preferably, the elastic layer 32 may be made of an elastomer material having a rubber hardness in a range of from about 5 degrees to about 50 degrees under JIS-A of Japanese Industrial Standards and a thickness in a range of from about 50 micrometers to about 500 micrometers. For example, the elastic layer 32 is made of silicone rubber, fluorosilicone rubber, or the like that imparts heat resistance to the elastic layer 32 at the fixing temperature.

The release layer 33 is made of a fluorocarbon resin such as polytetrafluoroethylene (PTFE), tetrafluoroethylene-perfluoroalkylvinylether copolymer (PFA), and tetrafluoroethylene-hexafluoropropylene copolymer (FEP), a mixture of these resins, or a heat resistant resin containing one or more of these fluorocarbon resins dispersed therein.

The release layer 33 covering the elastic layer 32 facilitates separation of toner of the toner image T on the recording medium P and paper dust adhered from the recording medium P to the fixing belt 4 from the fixing belt 4 even if oil (e.g., silicone oil) is not applied to the fixing belt 4. However, generally, such resin that facilitates separation of the toner of the toner image T on the recording medium P from the fixing belt 4 is not as flexible as rubber. Therefore, if the thicker release layer 33 is disposed on the elastic layer 32, it may degrade flexibility of the outer circumferential surface of the fixing belt 4, resulting in variation in gloss of the toner image T on the recording medium P. The release layer 33 has a thickness in a range of from about 5 micrometers to about 50 micrometers, preferably in a range of from about 10 micrometers to about 30 micrometers, to satisfy both separability and flexibility.

Optionally, a primer layer may be provided between the base layer 31 and the elastic layer 32 and between the elastic layer 32 and the release layer 33. Further, a durable layer may be disposed on an inner circumferential surface of the base layer 31 to improve durability of the fixing belt 4 sliding over the heating roller 1 and the fixing roller 3.

Preferably, the base layer 31 may include a heat generation layer, for example, a copper layer having a thickness in a range of from about 3 micrometers to about 15 micrometers and disposed on a substratum made of polyimide or the like.

As shown in FIG. 3, the pressing roller 2 is constructed of a tubular metal core 2*a*, a heat resistant elastic layer 2*b*, and a release layer 2*c*. The pressing roller 2 presses against the fixing roller 3 via the fixing belt 4 to form the fixing nip N between the pressing roller 2 and the fixing belt 4. The pressing roller 2 has an outer diameter in a range of from about 30 mm to about 80 mm. The elastic layer 2*b* has a thickness in a range of from about 0.3 mm to about 5.0 mm and an Asker hardness in a range of from about 20 degrees to about 50 degrees. The elastic layer 2*b* is made of heat resistant silicone rubber. The release layer 2*c*, made of a fluorocarbon resin and having a thickness in a range of from about 10 micrometers to about 100 micrometers, is disposed on the elastic layer 2*b* to facilitate separation of the fixed toner image T on the back side of the recording medium P contacting the pressing roller 2 from the pressing roller 2 during duplex printing.

The hardness of the elastic layer 2*b* of the pressing roller 2 is greater than that of the elastic layer 32 of the fixing belt 4. Accordingly, the pressing roller 2 deforms the fixing belt 4 and the fixing roller 3 into a recess at the fixing nip N. The recess causes the recording medium P passing through the fixing nip N to have a curvature at an exit of the fixing nip N that prevents the recording medium P from moving along the outer circumferential surface of the fixing belt 4. Consequently, the recording medium P separates from the fixing belt 4 readily, preventing jamming of the recording medium P.

Figure 5:
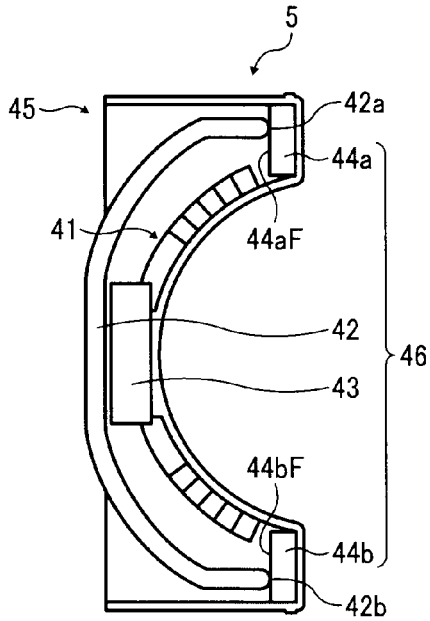
FIG. 5 is a vertical sectional view of an induction heater installed in the fixing device shown in FIG. 3.

Referring to FIG. 5, the following describes the induction heater 5 installed in the fixing device 40 described above.

FIG. 5 is a vertical sectional view of the induction heater 5 at one axial end of the heating roller 1 depicted in FIG. 3. As illustrated in FIG. 5, the induction heater 5 includes a casing 45, an exciting coil 41, and a core assembly 46. The core assembly 46 includes a center core 43, two side cores 44*a* and 44*b*, and a plurality of arch cores 42. The plurality of arch cores 42 is arranged in a longitudinal direction of the induction heater 5 parallel to an axial direction of the heating roller 1 depicted in FIG. 3. The center core 43, the side cores 44*a* and 44*b*, and the arch cores 42 surround the exciting coil 41, forming a magnetic path toward the heating roller 1 serving as a heating rotary body having a heat generation layer, that is, the metal core 1*a* depicted in FIG. 3.

The exciting coil 41 is constructed of litz wire wound around the center core 43 about 5 to 15 times. The litz wire is made of about 50 to 500 twisted conductive wires each of which is insulation coated and has a diameter in a range of from about 0.05 mm to about 0.20 mm. The litz wire is provided with a fusion layer constituting a surface layer. The fusion layer is solidified when it is heated by power supply or in a constant temperature bath. Thus, the litz wire wound around the center core 43 is fixed to the center core 43, maintaining its shape. Alternatively, litz wire without the fusion layer may be coiled and press-molded into a predetermined shape. Since the litz wire is required to have heat resistance at a temperature above the fixing temperature, its constituent wires are insulation coated with a heat resistant, insulating resin such as polyamideimide and polyimide.

The exciting coil 41 molded as described above is adhered to the casing 45 with a silicone adhesive, for example. The casing 45, which is required to have heat resistance at a temperature above the fixing temperature, is molded with a heat resistant resin such as polyethylene terephthalate (PET) and liquid crystalline polymer.

The core assembly 46 is made of manganese-zinc ferrite, nickel-zinc ferrite, or the like.

A ferrite core, such as the core assembly 46 made of the above-described ferrite, is produced by compression-molding and sintering ferrite powder. During a sintering process, the core is shrunk. Taking the arch core 42 for instance, a shrinkage of an edge portion in proximity to a span of the arch core 42 may differ from a shrinkage of other portion of the arch core 42, widening the span. Moreover, the shrinkage may vary among the plurality of arch cores 42 arranged in the longitudinal direction of the induction heater 5. Further, even in the identical arch core 42, the shrinkage may vary between an edge face 42*a* disposed at one end of the arch core 42 and an edge face 42*b* disposed at another end of the arch core 42 in the rotation direction A of the fixing belt 4. Accordingly, the edge face 42*a* of the arch core 42 contacts a planar face 44*a*F of the side core 44*a* differently from the edge face 42*b* of the arch core 42 contacting a planar face 44*b*F of the side core 44*b*.

As the arch core 42 contacts the side cores 44*a* and 44*b* in a greater area, an amount of magnetic flux generated by the exciting coil 41 that leaks from the core assembly 46 decreases, improving heating efficiency of the heating roller 1. That is, a portion of the heating roller 1 that corresponds to a region where a minimized amount of magnetic flux leaks from the core assembly 46 is heated more quickly. In other words, if the plurality of arch cores 42 contacts the side cores 44*a* and 44*b* in a varied area, the heating roller 1 may not be heated uniformly in the axial direction thereof, resulting in variation in fixing performance on the toner image T on the recording medium P in the axial direction of the heating roller 1.

To address this problem, the edge faces 42*a* and 42*b* of the arch core 42 have a vault shape that is convexly curved toward the side cores 44*a* and 44*b*.

Figure 6:
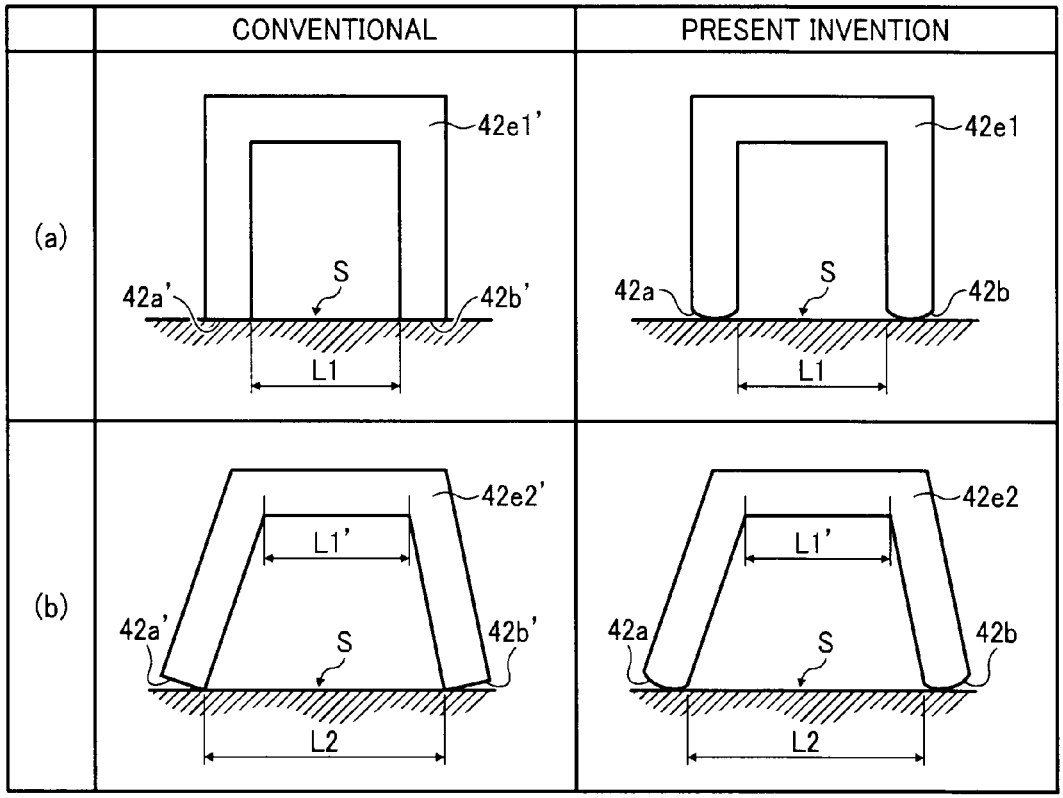
FIG. 6 is a diagram showing a vertical sectional view of conventional arch cores and arch cores installed in the induction heater shown in FIG. 5.

Referring to FIG. 6, the following describes the arch core 42 in detail.

FIG. 6 is a diagram showing a vertical sectional view of conventional arch cores 42*e*1' and 42*e*2' and arch cores 42*e*1 and 42*e*2 of the present invention.

FIG. 6 illustrates the conventional arch core 42*e*1' having planar edge faces 42*a*' and 42*b*' and the conventional arch core 42*e*2' having the planar edge faces 42*a*' and 42*b*' in the left column. FIG. 6 further illustrates the arch core 42*e*1 having the vault edge faces 42*a* and 42*b* and the arch core 42*e*2 having the vault edge faces 42*a* and 42*b* in the right column. The arch cores 42*e*1 and 42*e*2 are equivalent to the arch core 42 described above with reference to FIG. 5. The conventional arch core 42*a*1' and the arch core 42*e*1 are molded into a rectangular gutter having a span L1. The conventional arch core 42*e*2' and the arch core 42*e*2 are molded into a trapezoidal gutter in which a span L2 is wider than a bottom length L1' equivalent to the span L1.

The planar edge faces 42*a*' and 42*b*' of the conventional arch core 42*e*1' contact a plane S equivalent to the side cores 44*a* and 44*b* depicted in FIG. 5 across the entire region of the planar edge faces 42*a*' and 42*b*'. By contrast, the planar edge faces 42*a*' and 42*b*' of the conventional arch core 42*e*2' contact the plane S at a part of the planar edge faces 42*a*' and 42*b*', that is, at a corner edge of the planar edge faces 42*a*' and 42*b*'. In other words, the planar edge faces 42*a*' and 42*b*' contact the plane S in an area varying depending on the shape of the gutter of the conventional arch cores 42*e*1' and 42*e*2', that is, the rectangular gutter or the trapezoidal gutter. Contrarily, the vault edge faces 42*a* and 42*b* of the arch cores 42*e*1 and 42*e*2 according to this exemplary embodiment of the present invention contact the plane S over substantially an identical area regardless of the shape of the gutter of the arch cores 42*e*1 and 42*e*2. In other words, with the vault edge faces 42*a* and 42*b*, the differential in the size of the span between the rectangular gutter of the arch core 42*e*1 and the trapezoidal gutter of the arch core 42*e*2 does not vary an amount of magnetic flux leaking from the core assembly 46. Accordingly, even if the induction heater 5 is provided with arch cores of various shapes having different spans, that is, a mixture of the arch core 42*e*1 with the rectangular gutter having the span L1 and the arch core 42*e*2 with the trapezoidal gutter having the span L2, variation in a heating amount of the heating roller 1 is minimized in the axial direction thereof. Consequently, it is not necessary to examine the span of the gutter of the arch cores 42*e*1 and 42*e*2, perform finishing of the vault edge faces 42*a* and 42*b*, and eliminate the arch core 42*e*2 having the greater span L2 as a defective product, thus reducing manufacturing costs.

Preferably, the vault edge faces 42*a* and 42*b* may have a relatively great radius of curvature. If the vault edge faces 42*a* and 42*b* have an excessively small radius of curvature, both the arch cores 42*e*1 and 42*e*2 may leak a greater amount of magnetic flux generated by the exciting coil 41 from the core assembly 46. Preferably, the radius of curvature of the vault edge faces 42*a* and 42*b* is determined based on the span of the arch core 42, that is, the spans L1 and L2 of the arch cores 42*e*1 and 42*e*2.

Figure 7:
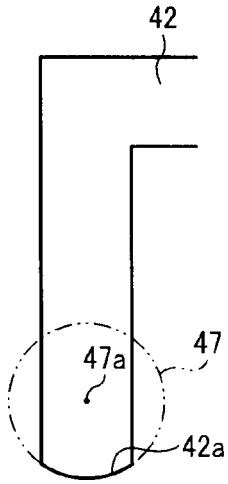
FIG. 7 is a partial vertical sectional view of an arch core installed in the induction heater shown in FIG. 5.

FIG. 7 is a partial vertical sectional view of the arch core 42. As shown in FIG. 7, the shape in cross section of the vault edge face 42*a* of the arch core 42 corresponds to the shape in cross section of a virtual cylinder 47 having a virtual axis 47*a* parallel to a rotation axis 1*c* of the heating roller 1 depicted in FIG. 3. That is, the vault edge face 42*a* is curved along a curved side face of the virtual cylinder 47. Accordingly, the vault edge face 42*a* linearly contacts the planar face 44*a*F of the side core 44*a* depicted in FIG. 5, minimizing an amount of leakage magnetic flux.

As shown in FIG. 5, the arch core 42 is substantially C-shaped. Alternatively, the arch core 42 may be semi-arcuate or may have other shapes, provided these shapes provide the above-described performance of the core of the induction heater 5.

As shown in FIG. 3, the induction heater 5 described above is installed in the fixing device 40 that includes the fixing belt 4. Alternatively, the induction heater 5 may be installed in a fixing device 40S that includes a fixing roller 3' instead of the fixing belt 4 as shown in FIG. 8.

Figure 8:
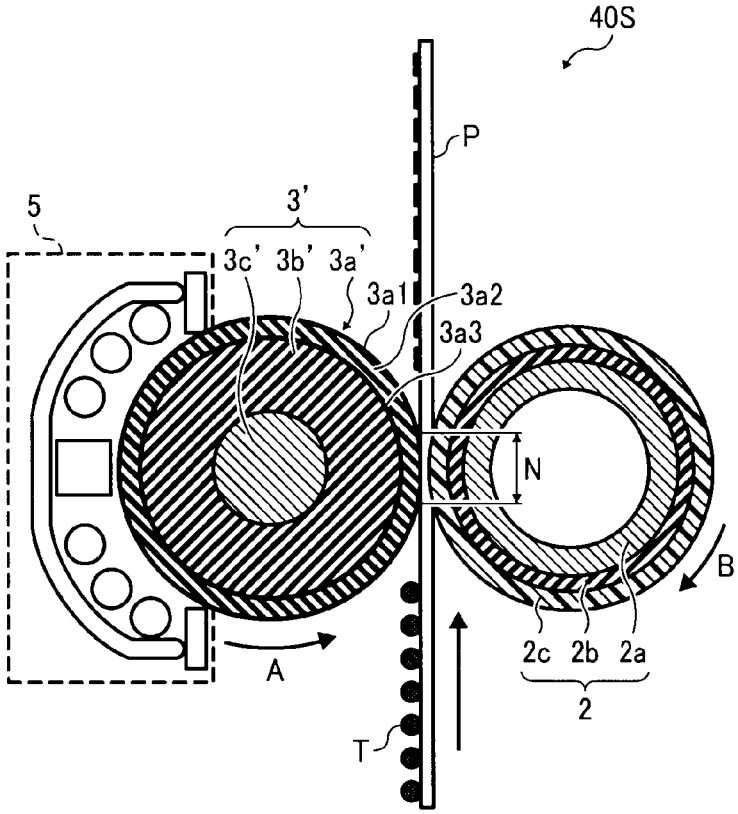
FIG. 8 is a vertical sectional view of a fixing device according to another exemplary embodiment of the present invention.

FIG. 8 is a vertical sectional view of the fixing device 40S. As illustrated in FIG. 8, the fixing device 40S includes the fixing roller 3' rotating in the rotation direction A and the pressing roller 2 pressed against the fixing roller 3' to form the fixing nip N therebetween and rotating in the rotation direction B counter to the rotation direction A of the fixing roller 3'. The induction heater 5 is disposed opposite the fixing roller 3' to heat the fixing roller 3' by electromagnetic induction. As a recording medium P bearing a toner image T passes through the fixing nip N, the fixing roller 3' heated by the induction heater 5 and the pressing roller 2 apply heat and pressure to the recording medium P, thus fixing the toner image T on the recording medium P.

The fixing roller 3' serving as a heating rotary body is constructed of a metal core 3*c*' made of stainless steel, carbon steel, or the like, an elastic layer 3*b*' disposed on the metal core 3*c*' and made of heat-resistant solid silicone rubber, silicone rubber foam, or the like, and a sleeve 3*a*' disposed on the elastic layer 3*b*'. The sleeve 3*a*' is constructed of a heat generation layer 3*a*3, an elastic layer 3*a*2 disposed on the heat generation layer 3*a*3 and made of an elastomer material, and a release layer 3*a*1, constituting an outer surface layer, disposed on the elastic layer 3*a*2 and made of a fluorocarbon resin, a heat resistant resin, or a mixture of these resins. Flanges disposed at lateral ends of the sleeve 3*a*' in an axial direction of the fixing roller 3' prohibit the sleeve 3*a*' from moving in the axial direction of the fixing roller 3'. Alternatively, the sleeve 3*a*' may be adhered to the elastic layer 3*b*'. The heat generation layer 3*a*3 is made of stainless steel or a magnetic shunt alloy having a thickness in a range of from about 10 micrometers to about 100 micrometers. The fixing device 40S includes the induction heater 5 that is identical to the induction heater 5 shown in FIG. 5.

The induction heater 5 heats the heat generation layer 3*a*3 of the fixing roller 3' to the fixing temperature. Thus, the fixing roller 3' heats the recording medium P passing through the fixing nip N at the fixing temperature and at the same time the fixing roller 3' and the pressing roller 2 apply pressure to the recording medium P, thus fixing the toner image T on the recording medium P.

Figure 9:
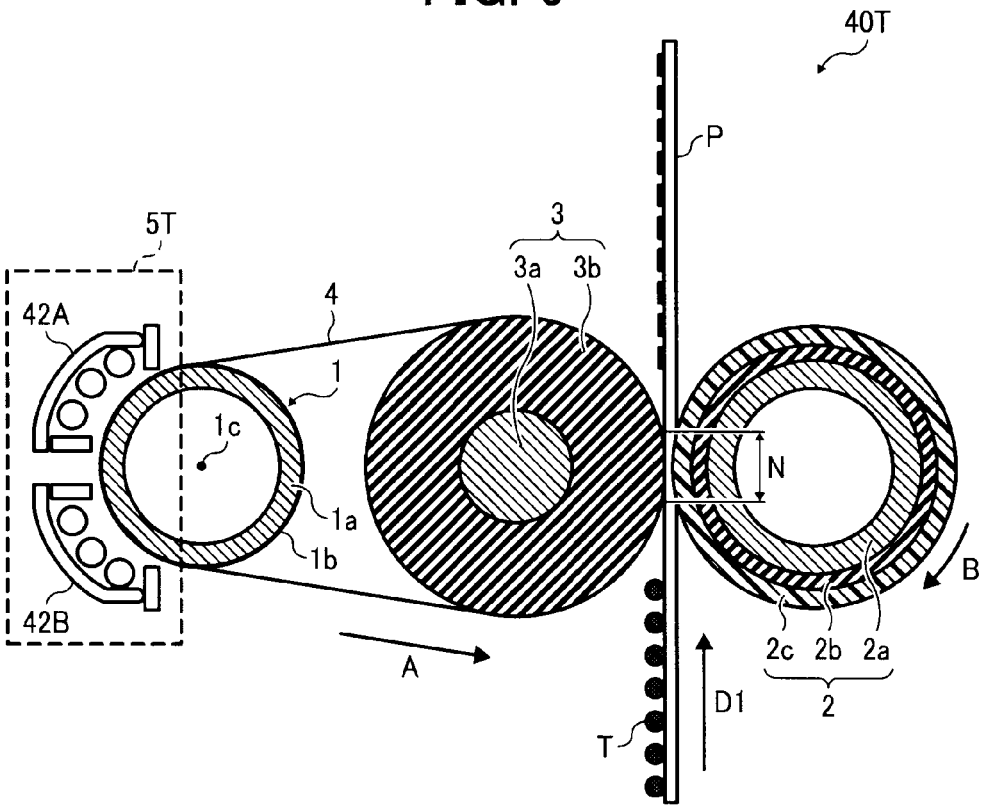
FIG. 9 is a vertical sectional view of a fixing device according to yet another exemplary embodiment of the present invention.
Figure 10:
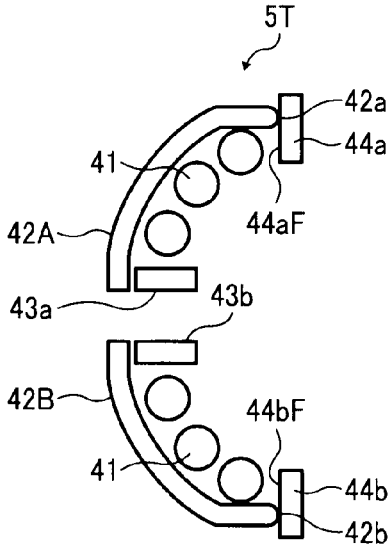
FIG. 10 is a vertical sectional view of an induction heater installed in the fixing device shown in FIG. 9.

As shown in FIG. 5, the arch core 42 of the induction heater 5 described above covers the entire exciting coil 41 wound around the center core 43. That is, the arch core 42 covers both an upper part of the exciting coil 41 disposed above the center core 43 and a lower part of the exciting coil 41 disposed below the center core 43. Alternatively, the arch core 42 may be divided into two parts that cover the upper part and the lower part of the exciting coil 41, respectively, as shown in FIGS. 9 and 10. Thus, for example, FIG. 9 is a vertical sectional view of a fixing device 40T including an induction heater 5T having two arch cores 42A and 42B. FIG. 10 is a vertical sectional view of the induction heater 5T. As illustrated in FIG. 10, the induction heater 5T includes the arch core 42A that covers the upper part of the exciting coil 41 and the arch core 42B that covers the lower part of the exciting coil 41. The arch core 42A includes the vault edge face 42*a* that contacts the planar face 44*a*F of the side core 44*a*. The arch core 42B includes the vault edge face 42*b* that contacts the planar face 44*b*F of the side core 44*b*. The induction heater 5T includes two center cores 43*a* and 43*b* instead of the single center core 43 shown in FIG. 5. The arch cores 42A and 42B contact the center cores 43*a* and 43*b* disposed between the upper part and the lower part of the exciting coil 41, respectively. With this configuration of the induction heater 5T, the arch cores 42A and 42B are downsized at reduced manufacturing costs while maintaining heating efficiency for heating the heating roller 1.

Figure 11:
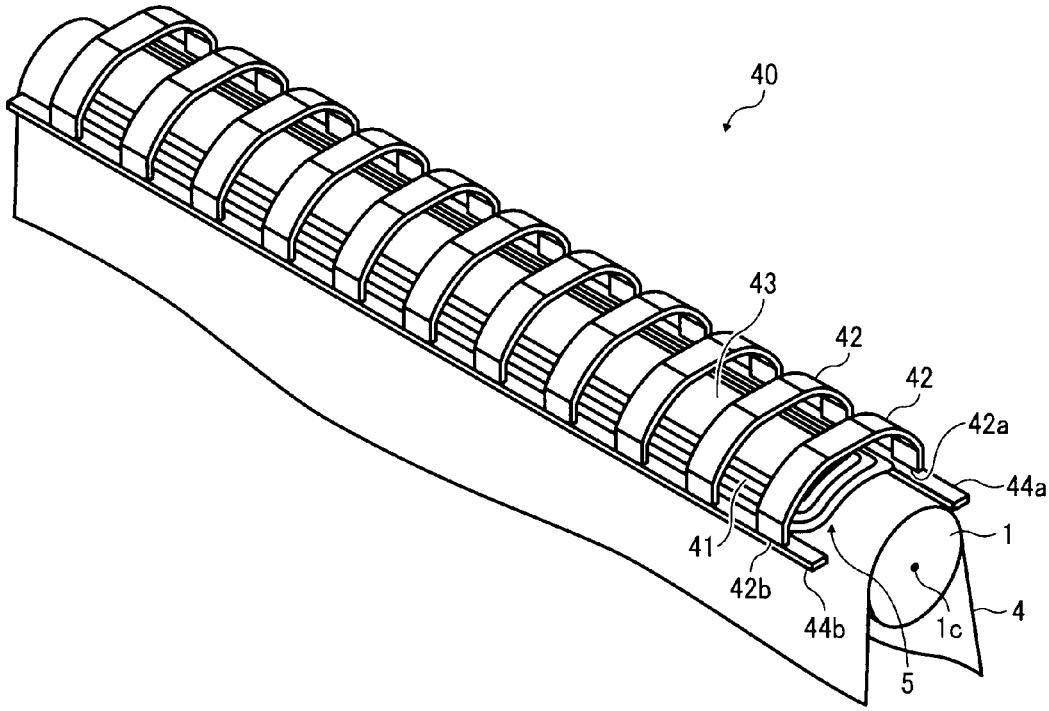
FIG. 11 is a perspective view of the induction heater shown in FIG. 5.

Referring to FIG. 11, the following describes first and second examples of the induction heater 5 installed in the fixing device 40 (depicted in FIG. 3) having the fixing belt 4.

FIG. 11 is a perspective view of the induction heater 5. In the first and second examples of the induction heater 5, eleven arch cores 42, each of which has a width of about 10 mm, are arranged in the longitudinal direction of the induction heater 5 parallel to the axial direction of the heating roller 1 with a predetermined interval of about 20 mm provided between the adjacent arch cores 42.

A description is now given of the first example of the induction heater 5.

The arch core 42 is designed to have a height of about 25 mm, a length in a direction orthogonal to the axial direction of the heating roller 1, that is, a span, of about 60.0 mm, and a thickness of about 2.5 mm. Each of the vault edge faces 42*a* and 42*b* of the arch core 42 is curved along the curved side face of the virtual cylinder 47 that has the virtual axis 47*a* (depicted in FIG. 7) parallel to the rotation axis 1*c* of the heating roller 1. Specifically, each of the vault edge faces 42*a* and 42*b* is curved along a circumferential curve of the virtual cylinder 47 having a radius of curvature of about 1.25 mm. Prototype arch cores 42 have a span that varies in a range of from about 60.5 mm to about 63.0 mm with respect to the designed span of about 60.0 mm.

The two arch cores 42 having the greatest span of about 63.0 mm are selected from among the prototype arch cores 42 and disposed at positions adjacent to the center arch core 42 disposed at a center position on the side cores 44*a* and 44*b* in the longitudinal direction of the induction heater 5 in such a manner that the two arch cores 42 having the greatest span sandwich the center arch core 42. The other arch cores 42, having a span in a range of from about 60.5 mm to about 61.0 mm, are disposed at other positions randomly.

The exciting coil 41 is made of litz wire constructed of 100 constituent wires, each of which has a diameter of about 0.15 mm, collectively twisted.

A description is now given of the second example of the induction heater 5.

The second example of the induction heater 5 is identical to the first example of the induction heater 5 described above except the radius of curvature of the virtual cylinder 47. Specifically, each of the vault edge faces 42*a* and 42*b* is curved along the circumferential curve of the virtual cylinder 47, having a radius of curvature of about 5.00 mm, which has the virtual axis 47*a* parallel to the rotation axis 1*c* of the heating roller 1. Like the first example of the induction heater 5, the two arch cores 42 having the greatest span of about 63.0 mm are selected from among the prototype arch cores 42 and disposed at the positions adjacent to the center arch core 42 disposed at the center position on the side cores 44*a* and 44*b* in the longitudinal direction of the induction heater 5 in such a manner that the two arch cores 42 having the greatest span sandwich the center arch core 42. The arch cores 42 having the span in a range of from about 60.5 mm to about 61.0 mm are disposed at other positions randomly.

A description is now given of first and second comparative induction heaters.

The first comparative induction heater is identical to the first example of the induction heater 5 described above except the shape of the edge faces of the arch core. For example, the planar edge faces 42*a*' and 42*b*' shown in FIG. 6 are employed instead of the vault edge faces 42*a* and 42*b* shown in FIG. 6. The two arch cores 42*e*2' having the greatest span of about 63.0 mm are disposed at positions adjacent to the center arch core 42*e*2' disposed at the center position on the side cores 44*a* and 44*b* in a longitudinal direction of the first comparative induction heater. The arch cores 42*e*2' having the span in a range of from about 60.5 mm to about 61.0 mm are disposed at other positions randomly.

The second comparative induction heater is identical to the first comparative induction heater described above except finishing of the planar edge faces 42*a*' and 42*b*' of the two arch cores 42*e*2' having the greatest span of about 63.0 mm. For example, cutting is performed to the planar edge faces 42*a*' and 42*b*' of the two arch cores 42*e*2' so that the planar edge faces 42*a*' and 42*b*' are fully in contact with the planar faces 44*a*F and 44*b*F of the side cores 44*a* and 44*b*, respectively.

A description is now given of results of an experiment evaluating the first and second examples of the induction heater 5 and the first and second comparative induction heaters described above.

Each of the first and second examples of the induction heater 5 and the first and second comparative induction heaters is installed in a Ricoh copier imagio C5000. A thermocouple disposed in proximity to an entry to the fixing nip N formed between the fixing belt 4 and the pressing roller 2 of the fixing device 40 shown in FIG. 3 measures the temperature of the outer circumferential surface of the fixing belt 4.

Figure 12:
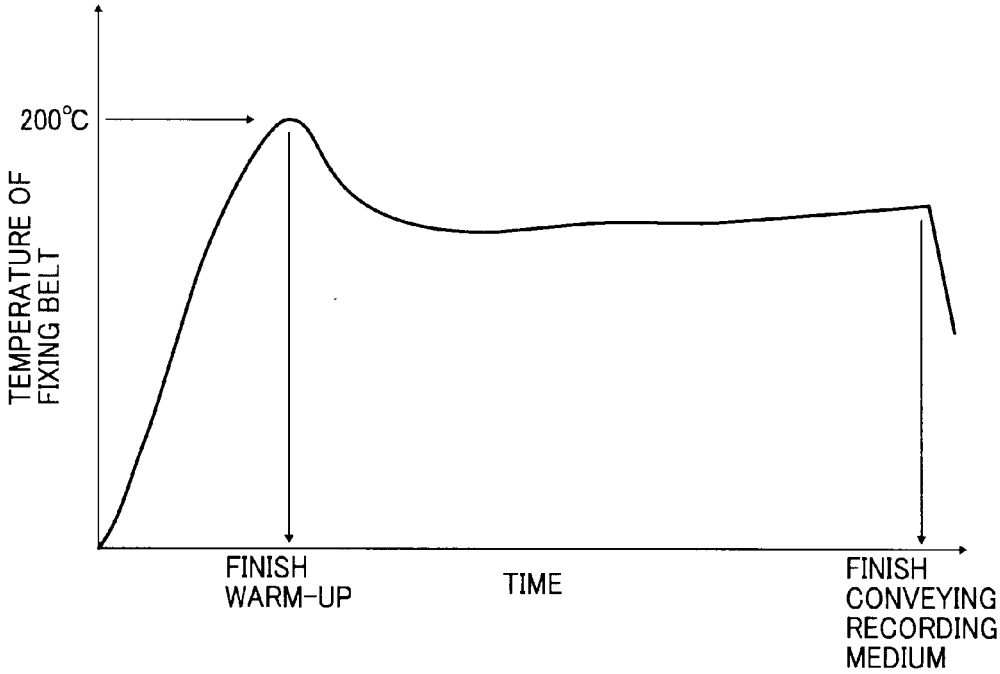
FIG. 12 is a graph showing a relation between time and a temperature of the fixing belt shown in FIG. 4.

FIG. 12 is a graph showing a typical change in the temperature of the fixing belt 4 detected by the thermocouple after starting the fixing device 40.

Upon starting the fixing device 40, the fixing belt 4 is heated to a target fixing temperature of 200 degrees centigrade. When the temperature of the fixing belt 4 reaches 200 degrees centigrade, that is, when the fixing device 40 has been warmed up, recording media P are conveyed through the fixing nip N formed between the fixing belt 4 and the pressing roller 2. When 50 recording media P have been conveyed through the fixing nip N, no more recording medium P is conveyed through the fixing nip N and heating and rotating of the fixing belt 4 is stopped.

Figure 13:
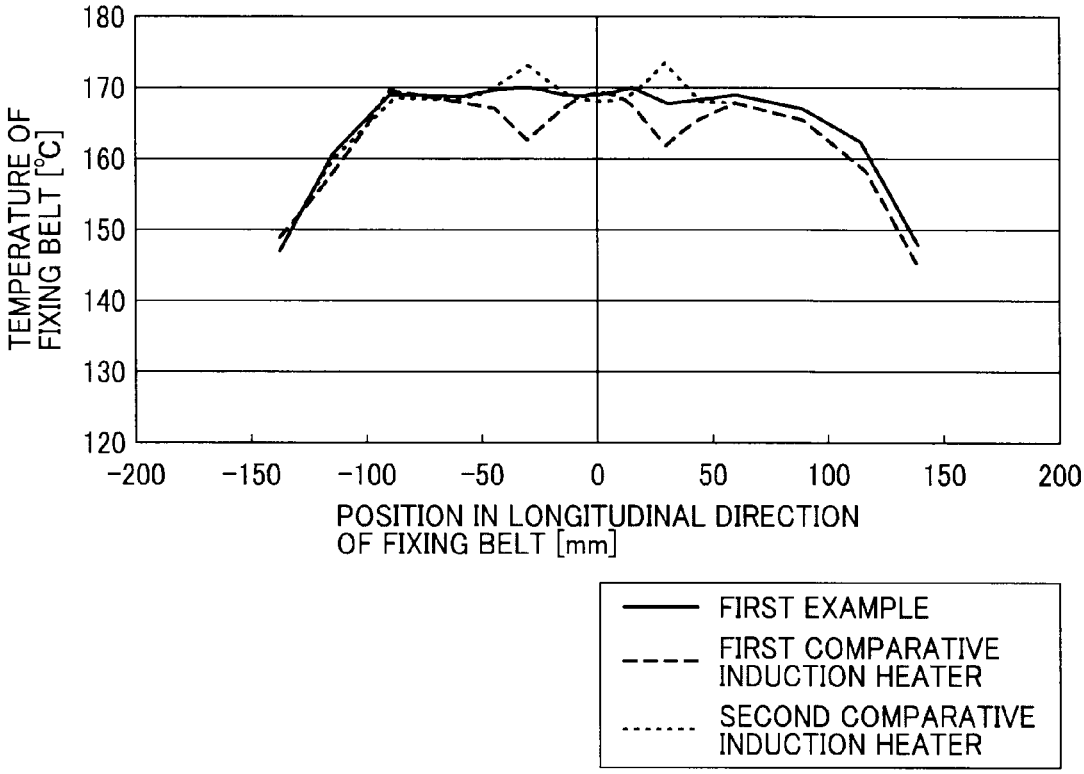
FIG. 13 is a graph showing a relation between a position on the fixing belt shown in FIG. 4 in a longitudinal direction thereof and the temperature of the fixing belt.

A first test of measuring the temperature of the fixing belt 4 immediately after 50 recording media P have been conveyed through the fixing nip N is performed with the first example of the induction heater 5 and the first and second comparative induction heaters. FIG. 13 is a graph showing a temperature distribution of the fixing belt 4 detected by the thermocouple in a longitudinal direction of the fixing belt 4 parallel to the axial direction of the fixing belt 4.

As shown in FIG. 13, with the first example of the induction heater 5, the fixing belt 4 attains a uniform temperature distribution in the longitudinal direction thereof. By contrast, with the first comparative induction heater, the temperature of the fixing belt 4 is decreased at the positions thereon disposed opposite the two arch cores 42*e*2' having the greatest span of about 63.0 mm. With the second comparative induction heater, the temperature of the fixing belt 4 is increased at the positions thereon disposed opposite the two arch cores 42*e*2' having the planar edge faces 42*a*' and 42*b*' applied with cutting.

It is assumed that if the two arch cores 42*e*2' having the greatest span of about 63.0 mm installed in the first comparative induction heater are disposed opposite lateral ends of the fixing belt 4 in the longitudinal direction thereof, and not at the positions sandwiching the center arch core 42*e*2', the temperature of the fixing belt 4 at the lateral ends thereof would be decreased to a temperature at which fixing is impossible.

A second test of measuring the temperature of a center of the fixing belt 4 in the longitudinal direction thereof that changes after starting the fixing device 40 is performed with the first and second examples of the induction heater 5.

Figure 14:
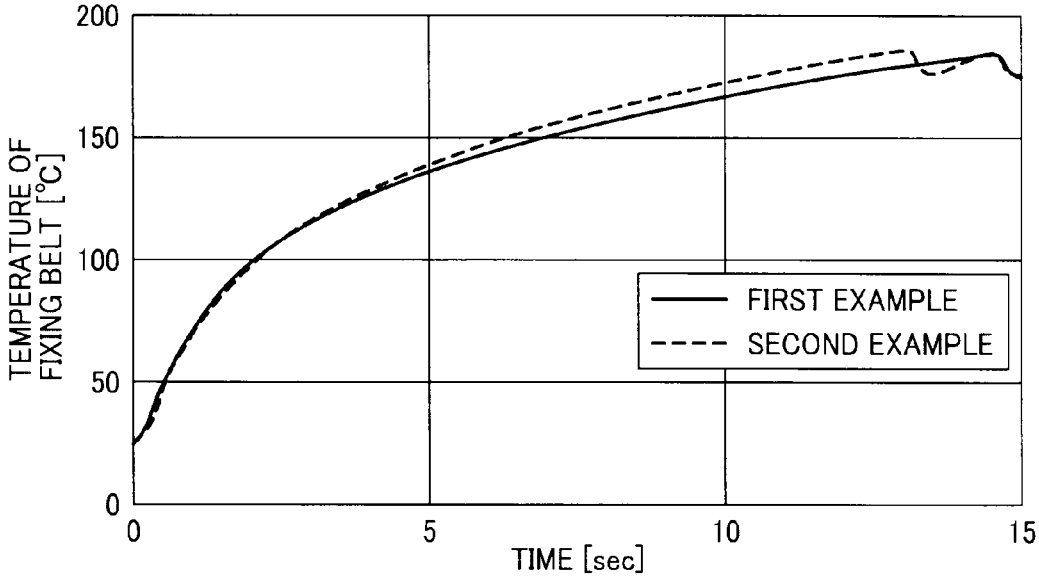
FIG. 14 is a graph showing a relation between time and the temperature of a center of the fixing belt in the longitudinal direction thereof.

FIG. 14 is a graph showing the temperature of the center of the fixing belt 4 in the longitudinal direction thereof changing over time.

As shown in FIG. 14, with the second example of the induction heater 5 having the vault edge faces 42*a* and 42*b* curved along the curved side face of the virtual cylinder 47 having the greater radius of curvature of about 5.00 mm, the temperature of the fixing belt 4 is increased more quickly than with the first example of the induction heater 5 having the vault edge faces 42*a* and 42*b* curved along the curved side face of the virtual cylinder 47 having the smaller radius of curvature of about 1.25 mm. This is because the second example of the induction heater 5 leaks a smaller amount of magnetic flux compared to the first example of the induction heater 5.

As shown by the evaluation experiment described above, the arch core 42 having the vault edge faces 42*a* and 42*b* improves the uniform temperature distribution of the fixing belt 4 in the axial direction thereof. Moreover, the curve of the vault edge faces 42*a* and 42*b* curved along the circumferential curve of the virtual cylinder 47 having the greater radius of curvature improves heating efficiency of the fixing belt 4.

Referring to FIGS. 3, 5, 6, 7, and 8, the following describes advantages of the induction heater 5. The vault edge faces 42*a* and 42*b* of the arch core 42 that contact the planar faces 44*a*F and 44*b*F of the side cores 44*a* and 44*b*, respectively, have a gentle curve, generating a magnetic path equivalent to a magnetic path generated by the planar edge faces 42*a*' and 42*b*' that contact the planar faces 44*a*F and 44*b*F of the side cores 44*a* and 44*b* across the entire opposed area of the planar edge faces 42*a*' and 42*b*' disposed opposite the side cores 44*a* and 44*b*. Accordingly, the induction heater 5 minimizes an amount of magnetic flux generated by the exciting coil 41 that leaks from between the vault edge faces 42*a* and 42*b* of the arch core 42 and the planar faces 44*a*F and 44*b*F of the side cores 44*a* and 44*b* contacting the vault edge faces 42*a* and 42*b*. Consequently, the magnetic flux generated by the induction heater 5 heats the heating rotary body (e.g., the heating roller 1 and the fixing roller 3') uniformly in the axial direction thereof, thus minimizing variation in the temperature of the heating rotary body in the axial direction thereof. Further, even if the arch core 42 is manufactured in the arcuate shape with low precision, the arch core 42 is serviceable as a product, resulting in reduction of defective products. Moreover, the vault edge faces 42*a* and 42*b* do not require additional cutting, reducing manufacturing costs substantially.

Additionally, the vault edge faces 42*a* and 42*b* of the arch core 42 are curved along the circumferential curve of the virtual cylinder 47 having the virtual axis 47*a* parallel to the rotation axis 1*c* of the heating rotary body. In other words, the vault edge faces 42*a* and 42*b* of the arch core 42 constitute a part of the curved side face of the virtual cylinder 47, effectively minimizing an amount of leakage magnetic flux from between the arch core 42 and the side cores 44*a* and 44*b* contacting the arch core 42.

The induction heater 5 is installable in either the belt type fixing device 40 depicted in FIG. 3 that includes the fixing belt 4 or the roller type fixing device 40S depicted in FIG. 8 that includes the fixing roller 3'. The fixing devices 40 and 40S are installable in the image forming apparatus 100 depicted in FIG. 2, thus forming a high quality toner image on a recording medium without faulty fixing due to variation in the temperature of the heating rotary body. Similarly, the induction heater 5T including the two arch cores 42A and 42B shown in FIG. 10 attains the advantages of the induction heater 5 described above. The induction heater 5T is also installable in either the belt type fixing device 40T or the roller type fixing device 40S. Like the fixing devices 40 and 40S, the fixing device 40T is installable in the image forming apparatus 100.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a heating rotary body to rotate in a predetermined direction of rotation, including a heat generation layer; and an induction heater to generate a magnetic flux toward the heating rotary body, disposed opposite the heating rotary body, the induction heater including:

a first side core disposed at one end of the induction heater in the direction of rotation of the heating rotary body and extending in an axial direction of the heating rotary body, the first side core including a planar face;

a second side core disposed at another end of the induction heater in the direction of rotation of the heating rotary body and extending in the axial direction of the heating rotary body, the second side core including a planar face;

a center core disposed between the first side core and the second side core in the direction of rotation of the heating rotary body;

an exciting coil to generate the magnetic flux, wound around the center core; and a plurality of arch cores arranged in the axial direction of the heating rotary body, each of which including:

a first vault edge face, having a curved cross-section when viewed along a line parallel to a rotation axis of the heating rotary body, disposed at one end of the arch core in the direction of rotation of the heating rotary body and contacting the planar face of the first side core; and a second vault edge face, having a curved cross-section when viewed along a line parallel to the rotation axis of the heating rotary body, disposed at another end of the arch core in the direction of rotation of the heating rotary body and contacting the planar face of the second side core.

2. The fixing device according to claim 1, wherein the adjacent arch cores are disposed at predetermined intervals along the axial direction of the heating rotary body.

3. The fixing device according to claim 1, wherein the heating rotary body includes a roller.

4. The fixing device according to claim 1, wherein the first vault edge face of each of the plurality of arch cores lineally contacts the planar face of the first side core and the second fault edge face of each of the plurality of arch cores lineally contacts the planar face of the second side core.

5. A fixing device comprising:

a heating rotary body to rotate in a predetermined direction of rotation, including a heat generation layer; and an induction heater to generate a magnetic flux toward the heating rotary body, disposed opposite the heating rotary body, the induction heater including:

a first side core disposed at one end of the induction heater in the direction of rotation of the heating rotary body and extending in an axial direction of the heating rotary body, the first side core including a planar face;

a second side core disposed at another end of the induction heater in the direction of rotation of the heating rotary body and extending in the axial direction of the heating rotary body, the second side core including a planar face;

a center core disposed between the first side core and the second side core in the direction of rotation of the heating rotary body;

an exciting coil to generate the magnetic flux, wound around the center core;

a plurality of first arch cores arranged in the axial direction of the heating rotary body, each of which including a first vault edge face, having a curved cross-section when viewed along a line parallel to a rotation axis of the heating rotary body, disposed at one end of the first arch core in the direction of rotation of the heating rotary body and contacting the planar face of the first side core; and a plurality of second arch cores arranged in the axial direction of the heating rotary body, each of which including a second vault edge face, having a curved cross-section when viewed along a line parallel to the rotation axis of the heating rotary body, disposed at one end of the second arch core in the direction of rotation of the heating rotary body and contacting the planar face of the second side core.

6. The fixing device according to claim 5, wherein the center core of the induction heater includes:

a first center core disposed between the first side core and the second side core in the direction of rotation of the heating rotary body and contacting the plurality of first arch cores; and a second center core disposed adjacent to the first center core and between the first side core and the second side core in the direction of rotation of the heating rotary body and contacting the plurality of second arch cores.

7. An image forming apparatus comprising the fixing device according to claim 1.

8. The fixing device according to claim 5, wherein the first vault edge face of each of the plurality of arch cores lineally contacts the planar face of the first side core and the second fault edge face of each of the plurality of arch cores lineally contacts the planar face of the second side core.

* * * * *